US005630727A

United States Patent [19]

Kameyama

[11] Patent Number: 5,630,727

[45] Date of Patent: May 20, 1997

[54] LEVER LOCK MECHANISM FOR LEVER FITTING TYPE CONNECTOR

[75] Inventor: Isao Kameyama, Haibara-gun, Japan

[73] Assignee: Yasaki Corporation, Tokyo, Japan

[21] Appl. No.: 525,426

[22] Filed: Sep. 7, 1995

[30] Foreign Application Priority Data

Sep. 9, 1994 [JP] Japan ..... 6-215627

[51] Int. Cl.[6] ..... H01R 13/627

[52] U.S. Cl. ..... 439/352; 439/157

[58] Field of Search ..... 439/157, 159, 439/160, 310, 352, 392; 403/321, 322, 325; 285/320, 208, 311

[56] References Cited

U.S. PATENT DOCUMENTS 5,135,408 8/1992 Suzuki .

5,230,635 7/1993 Takenouchi et al. .

5,344,194 9/1994 Hatagishi et al. ..... 439/157 X

*Primary Examiner*—Khiem Nguyen

*Attorney, Agent, or Firm*—Armstrong, Westerman, Hattori, McLeland & Naughton

[57] ABSTRACT

In a lever lock mechanism for a lever fitting type connector, the lever lock mechanism causes the lock arm to bend by engaging the spacer 6 with the guide rail of the housing, while the lever is connected by the lock arm of the connector housing. An interference portion having a slide contacting slope is formed on the spacer to a guide slope of the lock arm, and a contact projection part to the lever is formed, a piece having the contact projection part is protrusively formed at the spacer, an engaging projection part is formed on the inside of the guide rail to a loop piece formed on the spacer. As the other mechanism, the lever lock mechanism causes the spacer having lock arm to the lever to engage with freely slide condition at the guide rail. The spacer has a slide substrate to the guide rail, the lock arm has an extended projection pointed end part, a contact projection part to a claw portion of the lever is formed at the slide substrate.

4 Claims, 5 Drawing Sheets

LEVER LOCK MECHANISM FOR LEVER FITTING TYPE CONNECTOR

BACKGROUND OF THE INVENTION

1. Field of the Invention

This invention relates to a lever lock mechanism for lever fitting type connector in which the lever lock mechanism causes the connector fitting lever to lock by means of lock arm, and the lever lock mechanism can impose lock release of the lever easily in case of separating the connector.

2. Description of the Prior Art

FIGS. 12 and 13 show a conventional lever fitting type connector.

The connector, as shown in FIG. 12, has a female connector housing 41 made of synthetic resin and a working lever 42 also made of synthetic resin, wherein the working lever 42 is pivotally supported by the female connector housing 41 with axis so as to be turned freely. The connector causes a pin portion of the other male connector (not illustrated) to engage with the cam groove 43 of the working lever 42 in b&se end direction. With the turn motion of the working lever 42, the pin portion is pulled along the cam groove 43 as shown in FIG. 13, so that the lever lock mechanism causes the other male connector housing to join into the female connector housing 41.

A flexible lock arm 45 to the working lever 42 is formed at an outer wall 44 of the female connector housing 41. A working portion 42*a* causes the lock arm 45 to bend and then the working portion 42*a* can get over the lock arm 45 when the working lever 42 is turned- As shown in FIG. 14, a rear end 42*a*' of the working portion 42*a* comes into contact with a lock projection 46 of the lock arm 45, causing the working lever 42 to lock, so that the rear end 42*a*' prevents return of the working lever 42.

However, in the above-described conventional lever lock mechanism, in case of releasing lock of the working lever 42, causing the connector to remove, it must turn the working lever 42 while the lock arm 45 is depressing by a finger, and this results in a problem that the assembling is troublesome. Further, it is difficult to confirm by watching whether or not the locking is certainly put into practice since the lock arm 45 is in hiding by the working portion 42*a* of the working lever 42 after being locked.

SUMMARY OF THE INVENTION

In view of the foregoing, it is an object of the present invention to provide a lever lock mechanism for a lever fitting type connector which can easily and certainly carry out lock release of the lever and easily and surely confirm whether or not locking is performed securely.

According to the first aspect of the present invention, for achieving the above-mentioned object, there is provided a first lever lock mechanism for a lever fitting type connector in which a lever for use in fitting of the other connector is provided for a connector housing and a flexible lock arm to the lever is formed, a lock release spacer which is engaged with a guide rail formed on the connector housing on both sides of the flexible lock arm, wherein the lock release spacer causes locking condition to release by bending the flexible lock arm by virtue of the lock release spacer itself.

According to the second aspect of the present invention, there is provided the modified first lever lock mechanism for the lever fitting type connector in which, a guide slope is formed at a pointed end portion of the flexible lock arm, an interference portion having a slide contacting slope to the guide slope formed in the lock release spacer, a contact projection part to the lever is formed in the lock release spacer, a flexible working piece is protrusively formed on a base end of the lock release spacer, and the contact projection part is formed on the flexible working piece in the first lever lock mechanism.

According to the third aspect of the present invention, there is provided the further modified first lever lock mechanism for the lever fitting type connector in which, a flexible loop piece is feasible to insert into the guide rail in the lock release spacer, an engaging projection to the flexible loop piece is formed on the inside of the guide rail, a stop projection part to the lock release spacer is formed on the inlet side of the guide rail.

According to the fourth aspect of the present invention, there is provided a second lever lock mechanism for the lever fitting type connector in which a lock spacer having a flexible arm to the lever is freely slide engaged with the guide rail formed on the connector housing.

According to the fifth aspect of the present invention, there is provided the modified second lever lock mechanism in which, a slide substrate to the guide rail is provided for the lock spacer, a projecting pointed end part extended from the substrate is provided for the flexible lock arm, a contact projecting part to the claw portion formed on the lever, which is formed on the slide substrate, a stop projection part to the slide substrate is formed on the inlet side of the guide rail.

As stated above, the first lever lock mechanism for the lever fitting type connector according to the present invention in which the lock release spacer causes the flexible lock arm to bend in the direction of lock release, while the lock release spacer moves through the inside of the guide rail, and comes into contact with the flexible lock arm. In virtue of this, it becomes possible to turn the lever for separating the connector. Contact between the spacer and the lock arm is practically performed by contact between the guide slope of the lock arm and the slide contacting slope of the spacer. The spacer is pushed up by the reaction force of restitution of the lock arm, the contact projection part of which is pressure contacted with the lever. The contact projection part causes the flexible working piece to get under the inside of the lever by depressing thereof.

Engagement between the lever and the spacer is released by virtue that the lever lock mechanism causes the spacer to move slide in the direction of bending of the lock arm, and lever is integrally moved with the spacer by the frictional force between the contact projection part and the lever. The flexible loop piece of the spacer is maintained on the engaging projection part by elastic reaction force while elastically deforming by pressing toward the engaging projection part on the inside of the guide rail with the slide movement of the spacer. In the lock state of the lever, the flexible working piece projects outward, and in the lock release state, gets into hollow part between the guide rails.

As stated above, the second lever lock mechanism for the lever fitting type connector according to the present invention in which the lock spacer has the freely slide movement state through the inside of the guide rail. With the lever turning motion in the connector fitting, the spacer slides in the direction of getting out by pressing the contact projection part with the claw portion of the lever. At the same time, the lock arm bends because the lock arm is pressed, and then the lock arm connects the lever. The spacer causes the projection pointed end part to project outward with the slide substrate touched to the stop projection part. In case of releasing lock of the lever, the lever lock mechanism causes the lock arm to bend by pressing the projection pointed end part of lock arm, and engagement between the lock arm and the lever is released.

The above and further objects and novel features of the invention will be more fully understood from the following detailed description when the same is read in connection with the accompanying drawings. It should be expressly understood, however, that the drawings are for purpose of illustration only and not intended as a definition of the limits of the invention.

DETAILED DESCRIPTION OF THE PREFERRED EMBODIMENTS

A preferred embodiment of the present invention will now be described in detail referring to the accompanying drawings.

FIGS. 1 to 5 show a lever lock mechanism for lever fitting type connector according to the first embodiment of the present invention.

Figure 12:
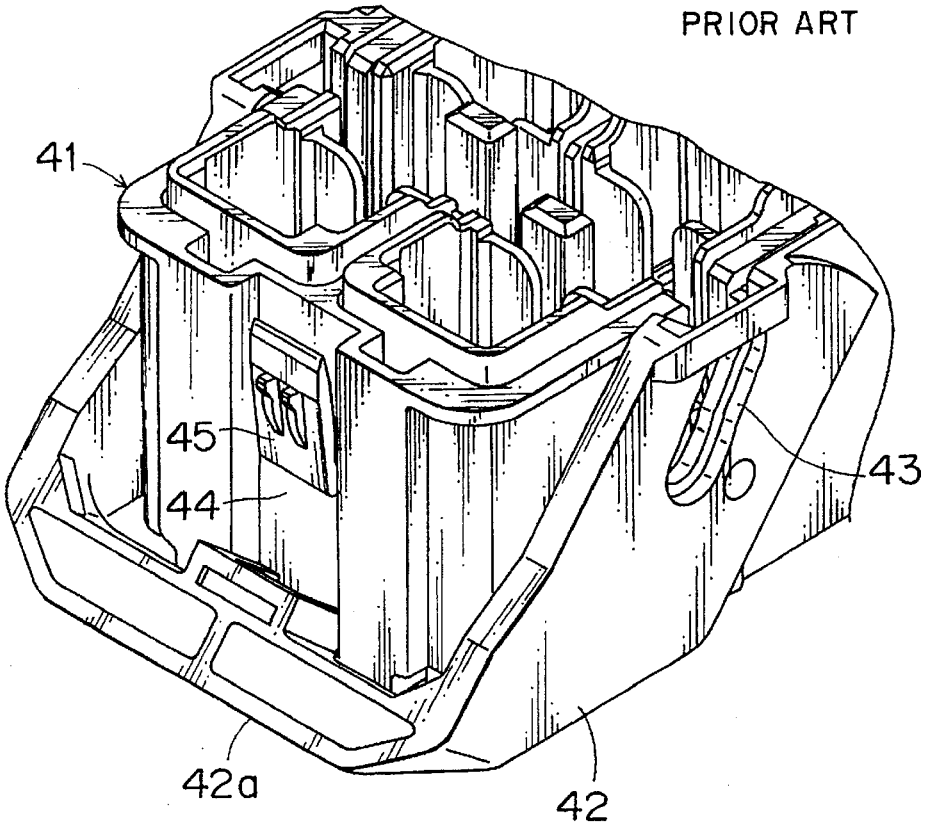
FIG. 12 is a perspective view showing a conventional example of the lever lock mechanism.
Figure 13:
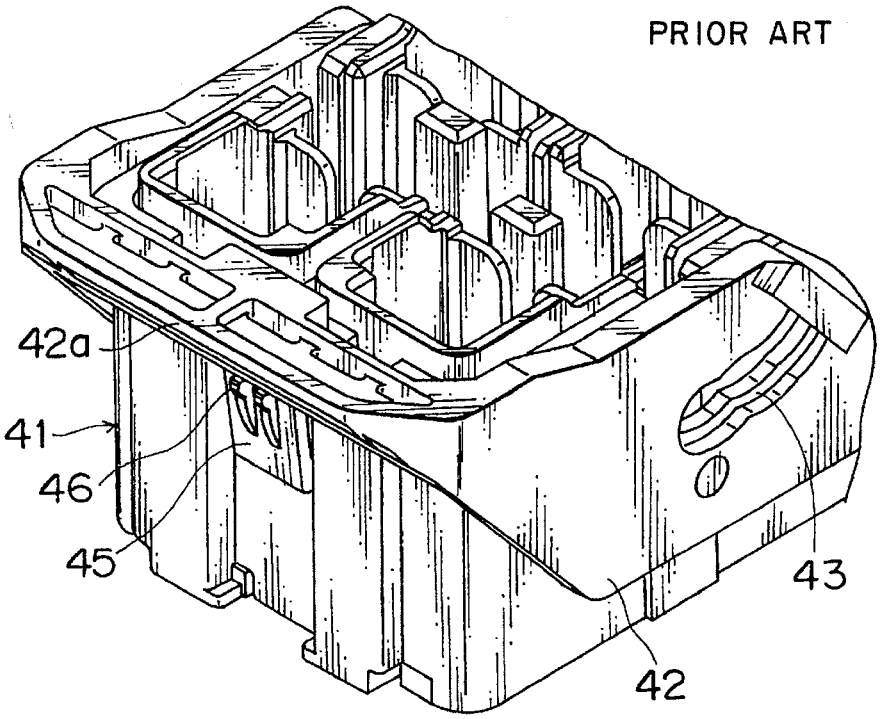
FIG. 13 is a perspective view showing a lock state of the lever according to the conventional lock mechanism.

The descriptions of the connector housing 1 and the lever 2 are omitted here to avoid unnecessary repetition because these are the same as the above conventional example as shown in FIG. 12.

Figure 1:
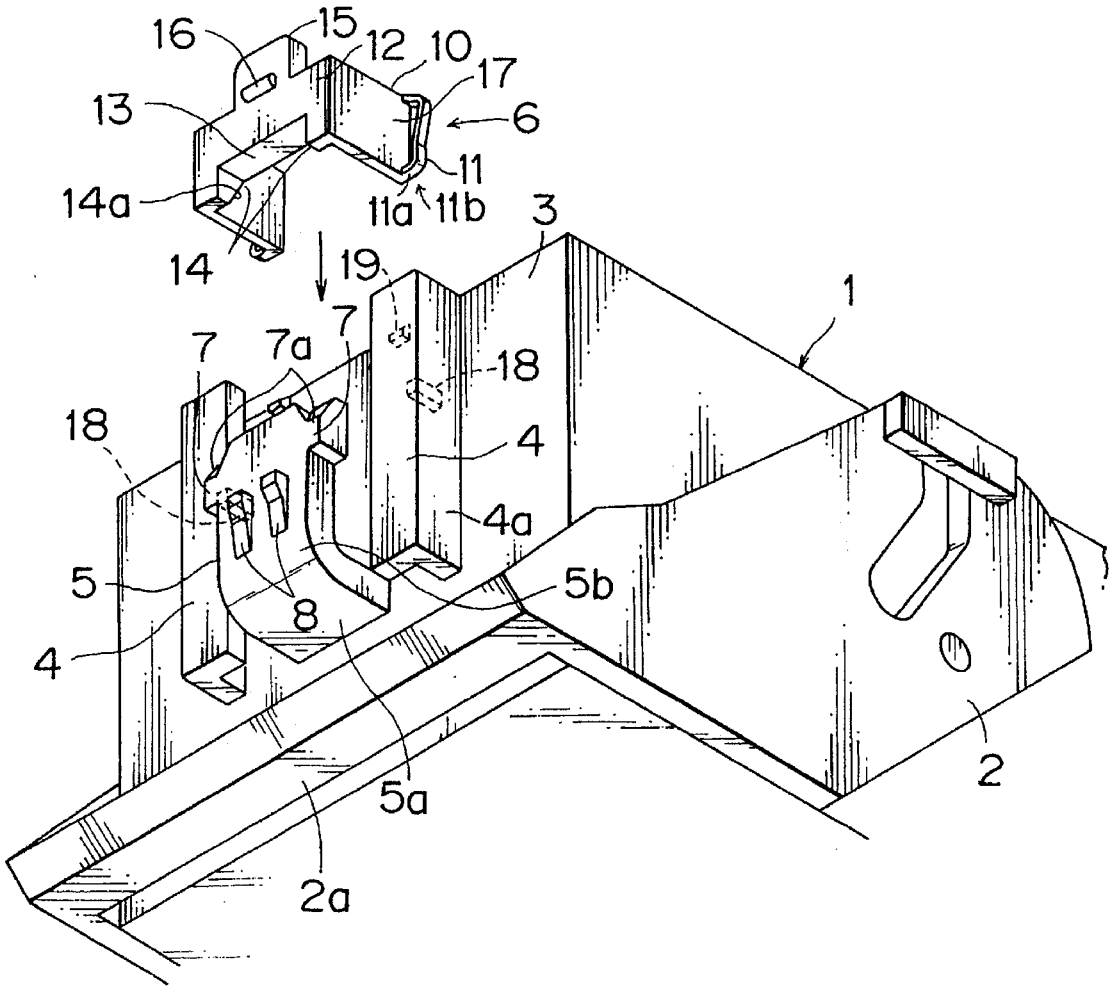
FIG. 1 is an exploded perspective view showing a lever lock mechanism according to a first embodiment of the present invention.

As shown in FIG. 1, the lever lock mechanism comprises a pair of guide rail 4, 4 which has the configuration of lateral L-shaped section formed at the outer wall 3 of the connector housing 1, a flexible lock arm 5 arranged in the center of the pair of guide rail 4, 4 and a lock release spacer 6 inserted into the guide rail 4 toward the lock arm 5.

The lock arm 5 comprises an arm base portion 5*a* projected from the outer wall 3 of the connector housing 1, a substrate portion 5*b* extended parallel to the outer wall 3 from the arm base portion 5*a*, a pair of overhang portions 7, 7 projected to the both sides (direction of guide rail 4) of the pointed end part of the substrate portion 5*b*, and a lock projection 8 formed in the center of the substrate portion 5*b*. The pair of overhang portion 7, 7 have an upward guide slope 7*a* at a pointed end thereof. The lock release spacer 6 is come into contact with and engaged with the lock arm 5 at the pointed end direction thereof.

The lock release spacer 6 has a body portion 10 formed reverse concave shaped section and a flexible loop piece 11 projected at the both sides of the body portion. At the center of pointed end direction of a top wall 12 of the body portion 10, a notching for recess 13 to the lever 2 is formed. At the both sides of the notching recess 13, a pair of interference portion 14 to the overhang portion 7 is formed. The interference portion 14 has a downward slide contacting slope 14*a* toward the upward guide slope 7*a* of the overhang portion 7.

At a base end of the top wall 12, a flexible working piece 15 is protrusively formed with the same height as the top wall 12. At an end portion of the flexible working piece 15, a contact projection 16 toward the lever 2 is formed. A spring force toward the thickness direction of the flexible working piece 15 is strongly established than the reaction force of restitution of the lock arm 5. On the other hand, at a lower end direction of the both side walls 17 which is vertically descended from the top wall 12, the flexible loop piece 11 is protrusively formed toward the outer direction. The flexible loop piece 11 which presents rough ear model configuration in the free condition, comprises a concave shape curved portion 11*a* of the pointed end direction of the spacer and a convex shape curved portion 11*b* of the rear end direction thereof.

At the guide rail 4 into which the flexible loop piece 11 is inserted, in the intermediate portion thereof, an engaging projection 18 to the flexible loop piece 11 inward a rail side wall portion 4*a* is formed. In the pointed end direction of the guide rail 4, a stop projection 19 to the base end of the side wall 17 of the spacer 6 at the outer wall 3 of the connector housing 1 is formed.

Figure 2:
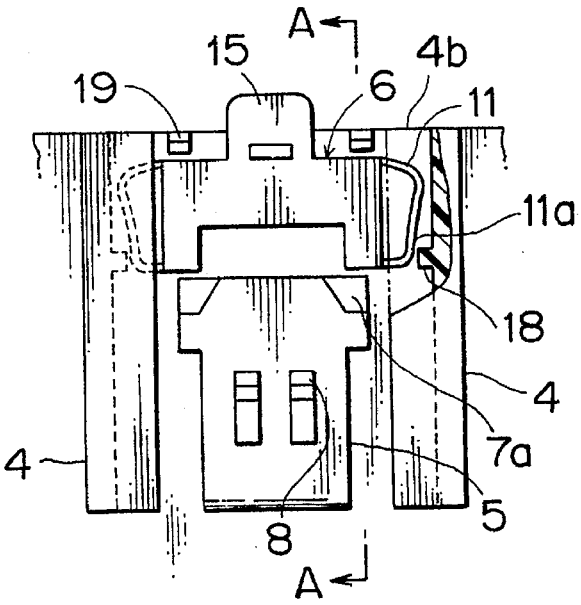
FIG. 2 is a front elevation view showing a temporary connecting state of a spacer according to a first embodiment of the present invention.
Figure 3:
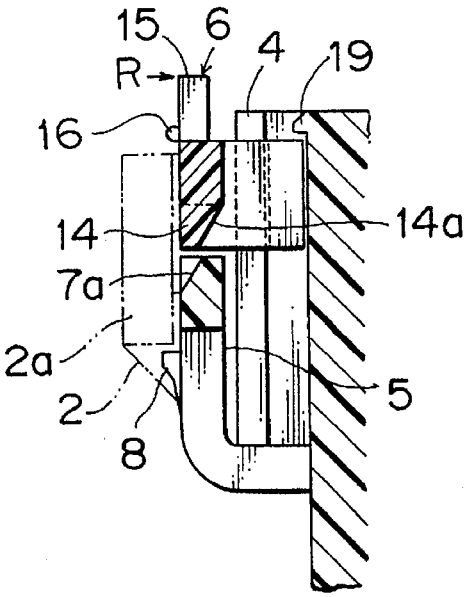
FIG. 3 is a cross sectional view showing a lock state of the lever taken along the line A—A in FIG. 2.

As shown in FIGS. 2 and 3, the spacer 6 is engaged with the guide rail 4 after getting over the stop projection 19. The spacer 6 is temporary connected in such a condition that the concave shape curved portion 11*a* of the flexible loop piece 11 comes into contact with the engaging projection 18. In the temporary connecting state of the spacer 6, the flexible working piece 15 is projected from the inlet end 4*b* of the guide rail 4 that is the pointed end of the connector housing 1 (FIG. 1) to the outer portion. At this state, as shown in FIG. 3, the male connector and the female connector are joined with each other by turning motion of the lever 2, and the lever lock mechanism causes the operating portion 2*a* of the lever 2 to connect to the lock projection 8 of the lock arm 5.

Figure 4:
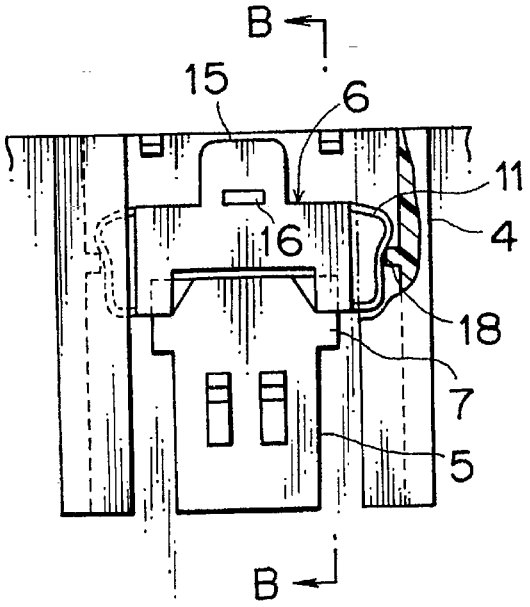
FIG. 4 is a front elevation view showing a forced condition of the spacer according to the first embodiment of the present invention.
Figure 5:
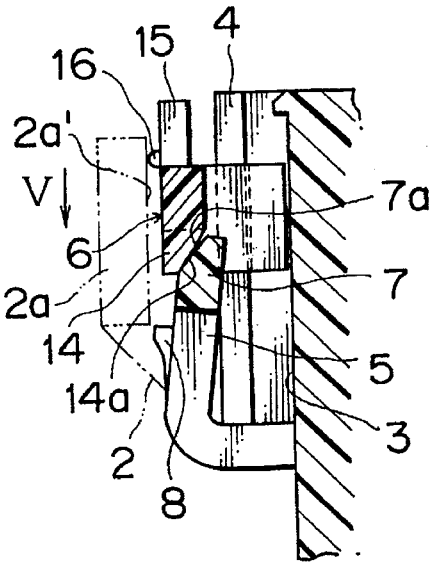
FIG. 5 is a cross sectional view showing a lock release state taken along the line B—B in FIG. 4.
Figure 14:
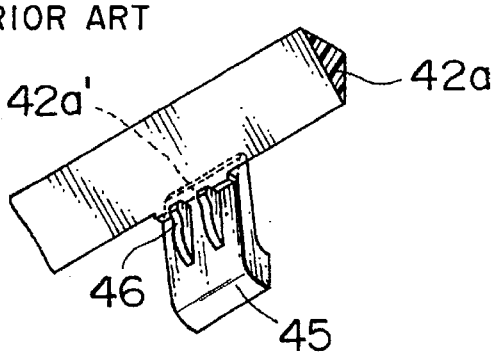
FIG. 14 PRIOR ART
FIG. 14 is a perspective view of an essential parts showing a lock state of the lever according to the conventional lock mechanism.

In connector separating, when the lever lock mechanism releases lock of lever 2, as shown in arrows R of FIG. 3, the lever lock mechanism causes the flexible working piece 15 of the spacer 6 to bend by depressing downward thereof and the lever lock mechanism causes the spacer 6 to advance along the guide rail 4 toward the lock arm direction. As shown in FIGS. 4 and 5, the lever lock mechanism causes the interference portion 14 of the pointed end portion of the spacer to touch by pressing toward the overhang portion 7 of the pointed end portion of the lock arm, with the condition that the lever lock mechanism causes the contact projection 16 of the piece 15 to get under on the rear side of the operating portion 2*a* of the lever 2.

As a result thereof, the slide contacting slope 14*a* of the interference portion 14, which comes into slide contact with the guide slope 7*a* of the overhang portion 7, which causes the lock arm 5 to bend by depressing toward the housing outer wall 3. The spacer 6 which is energized toward the pushing up direction by the reaction force of the bent lock arm 5 causes the contact projection 16 to touch to the rear side 2*a*' of the operating portion 2*a* of the lever 2. In this condition, the engagement between the operating portion 2*a* of the lever 2 and the lock projection 8 of the lock arm 5 is released since the lever 2 is integrally moved with the spacer 6 by the frictional force between the contact projection 16 and the rear side 2*a*' of the lever toward the arrows V direction by making the spacer 6 slide forward.

As shown in FIG. 4, with movement of the spacer 6, the flexible loop piece 11 bends and deforms because the flexible loop piece 11 is pushed by the engaging projection 18 on the inside of the guide rail 4. In the intermediate portion, the flexible loop piece 11 stops because of the pressure by the engaging projection 18. With releasing operation, by elasticity of the flexible loop piece 11, the spacer 6 returns toward its initial position and stops. In lock release of the lever 2, the flexible working piece 15 of the spacer 6 places between the pair of guide rail.

According to the present embodiment, it can easily release locking of the lever 2 by slide motion of the spacer 6. Certain engagement with regard to the lock arm 5 is carried out since lateral slippage of the spacer is absorbed by the flexible loop piece 11. Further, the lock arm 5 is protected by the spacer 6 at the time of spacer temporary connection.

FIGS. 6 to 11 show the lever lock mechanism according to the second embodiment of the present invention.

Figure 6:
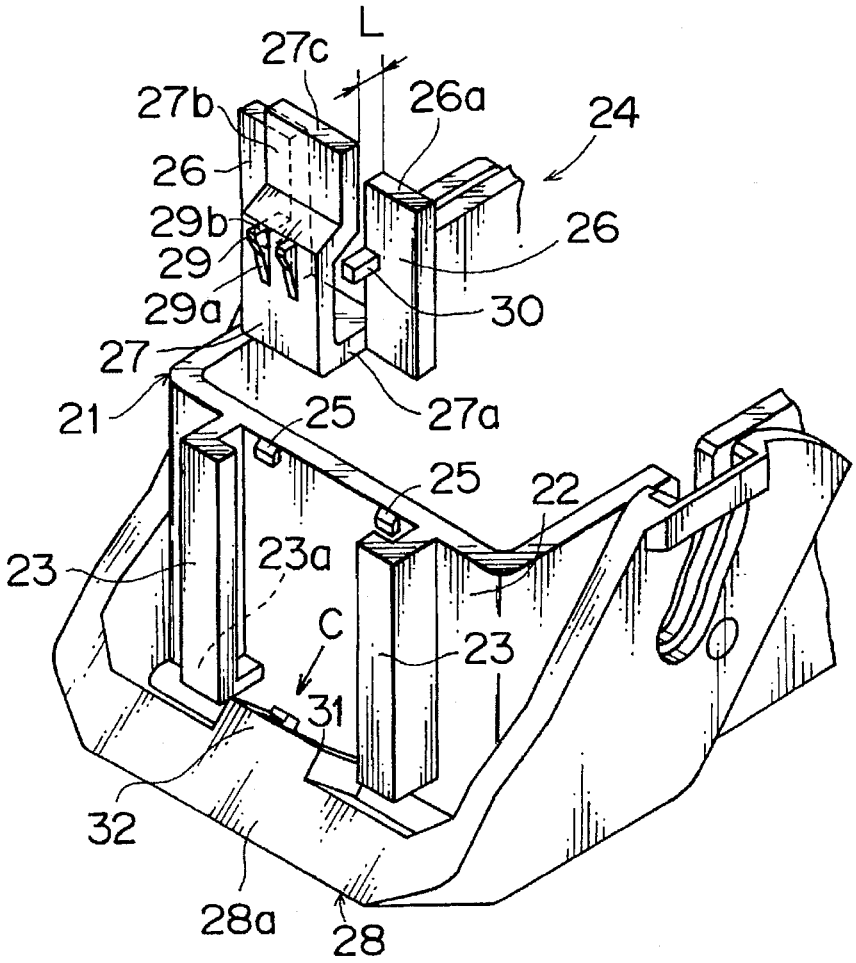
FIG. 6 is an exploded perspective view showing a lever lock mechanism according to a second embodiment of the present invention.

As shown in FIG. 6, the lever lock mechanism comprises a pair of guide rail 23, 23 formed on the outer wall 22 of the connector housing 21, and a lock spacer 24 inserted into the guide rail 23. At the inlet side of the guide rail 23, namely at the pointed end edge of the housing outer wall 22, a stop projection 25 to the lock spacer 24 is formed.

The lock spacer 24 comprises a pair of slide substrate 26, 26 to the guide rail 23 and a flexible lock arm 27 continuously formed between the pair of slide substrate 26, 26. The lock arm 27 is formed in such a way that the lock arm 27 causes the arm base portion 27*a* to rise integrally from the inside of the front end portion of the slide substrate 26. At the pointed end direction of the lock arm 27, the projected end portion 27*c* is projected to the rear direction over the rear end 26*a* of the slide substrate 26 in such conditions that the projected end portion 27*c* is faced to the side of the slide substrate 26 and is projected through the downward slope portion 27*b*. The projected end portion 27*c* is placed slightly upward over the slide substrate 26, and has downward margin to bend L of the arm.

The slide substrate 26 is freely slide engaged between the terminal wall 23*a* of the guide rail 23 and the stop projection 25 on the inside of the guide rail 23. Since the second lever lock mechanism compels the spacer 24 to insert into the guide rail 23 through the stop projection 25, falling off of the spacer 24 is prevented by the stop projection 25.

In the intermediate portion of the lock arm 27, a lock projection 29 to the lever 28 is formed. At a little to the front of each slide substrate 26, a pair of contact projection 30, 30 to the lever 28 is formed. The lock projection 29 has a forward slope surface 29*a* and a backward contact surface 29*b*, the contact projection 30 has a rectangular short pillar-shaped configuration.

Figure 8:
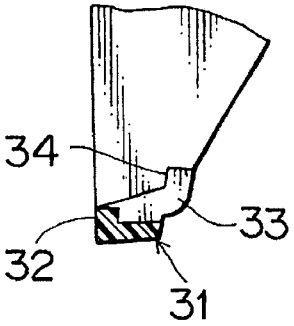
FIG. 8 is a cross sectional view taken along the line D—D in the FIG. 7.
Figure 7:
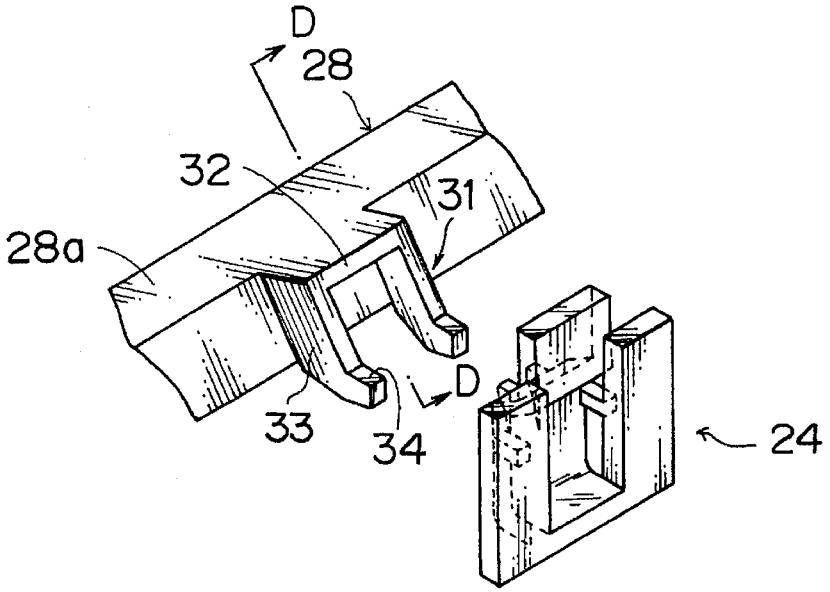
FIG. 7 is a perspective view showing the lever taken in the direction of the arrows C in FIG. 6.

FIG. 7 is a perspective view showing the engaging portion 31 of the lever 28 to the spacer 24 taken in the direction of the arrows C in FIG. 6. FIG. 8 is a cross sectional view taken along the line D—D in the FIG. 7. The engaging portion 31 comprises a connecting wall portion 32 projected inward from the front end of lever operating portion 28*a*, a side wall 33 formed extendedly backward on the both side of the connecting wall 32, and a pair of claw portion 34 formed protrusively to the back end direction of the side wall 33.

Figure 9:
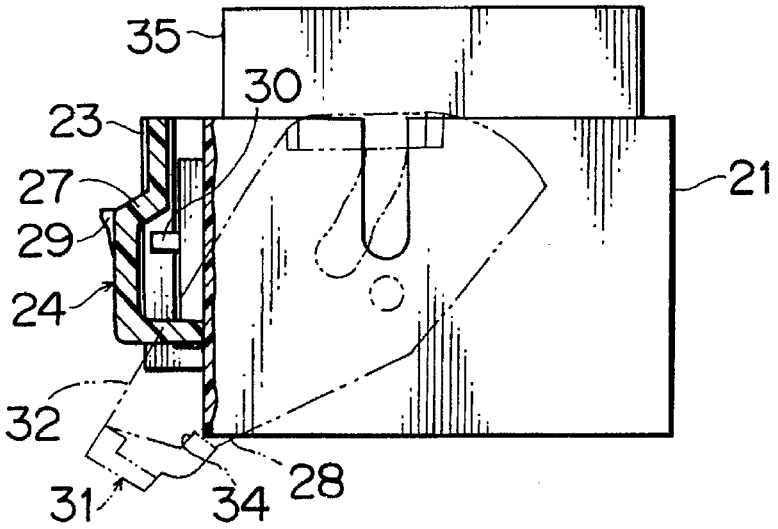
FIG. 9 is a side elevation view showing an operation (state of before lock) according to the second embodiment of the present invention.
Figure 10:
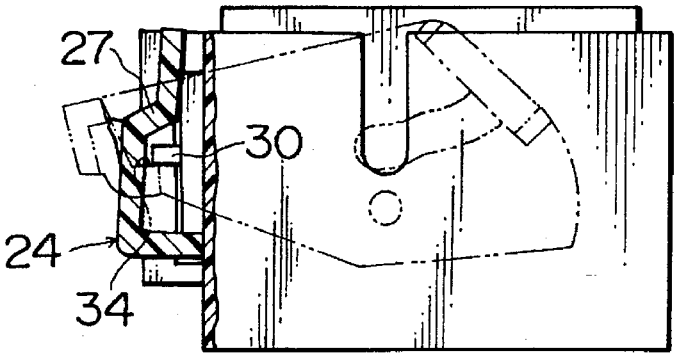
FIG. 10 is a side elevation view showing a lock state of the lever according to the second embodiment of the present invention.

As shown in FIG. 9, the other male connector housing 35 is set with the spacer 24 freely slide engaged with the inside of the guide rail 23, causing the lever 28 to turn. Beside, in the drawings, only the connector housing is shown. Originally, the male connector comprises in such a way that the electric wire with terminal is installed in the housing 35. The formation of the female connector housing 21 is the same as above male connector housing. With turning the lever 28, as shown in FIG. 10, the connecting wall portion 32 of the engaging portion 31 of the lever causes the lock arm 27 to bend by depressing downward while the claw 34 of the lever 28 is pressing the contact projection 30 of the spacer 24 forward.

Figure 11:
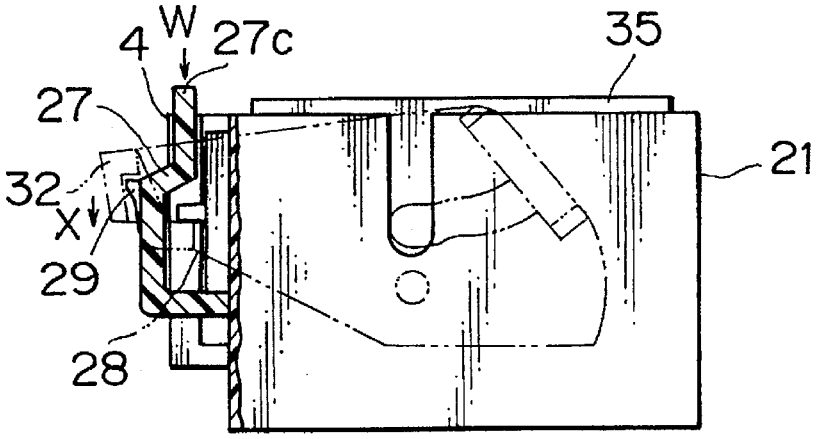
FIG. 11 is a side elevation view also showing a lock state of the lever according to the invention.

As shown in FIG. 11, the connecting wall 33 engages with the lock projection 29 of the lock arm 27, and then it prevents the return of the lever 28 by extruding the lever 28 toward the outside by virtue of the reaction force of restitution of the lock arm 27. Under the locking condition as shown in FIG. 11, since the projecting end portion 27*c* of the locking arm 27 is protrusively positioned from the pointed end of the connector housing 21 and from the guide rail 4, thus the projecting end portion 27*c* causes the lock completion to perceive to the operator.

In the lock release condition, while the second lock mechanism causes the lock arm 27 to bend downward by pressing forward the projection end 27*c* of the lock arm 27 as shown in arrows W, causing the lock projection 29 to remove from the engaging wall 32. With this condition, if the second lever lock mechanism causes the lever to turn in the separating direction as shown in arrows X, the male connector housing 35 is separated from the female connector housing 21. According to the present embodiment, it can certainly detect the presence of the lock condition by visual confirmation, and it can certainly release the lock of the lever 28 by simple operation of pressing the projection end portion 27*c*.

As described above, according to the present invention, it can certainly perform the lock release of the lever in such a simple operation that the operator causes the lock release spacer or the lock spacer to move slide by pressing thereof.

The operator can certainly detect the presence of the lock release by visual confirmation that in the lock state of the lever, both the piece of the lock release spacer and the projection pointed end part of the lock arm of the lock spacer project outward, and that in the lock release state, the projection pointed end portion gets into the inside of the rail.

In particular, by the contacting friction of the contact projection part as described in the first embodiment, the lock release can very easily be performed because the lever lock mechanism causes the lock state of the lever to release by integral movement of the lever simultaneously with the slide motion of the lock release spacer.

Further, since the claw portion of the lever according to the second embodiment pushes the contact projection of the lock spacer, and the projection pointed end portion of the lock arm projects outward simultaneously with locking of the lever, it can certainly be performed the lock state detection.

While preferred embodiments of the invention have been described using specific terms, and it is to be understood that changes and variation may be made without departing from the spirit or scope of the following claims.

What is claimed is:

1. A lever lock mechanism for a lever fitting type connector in which a lever for use in fitting for the other connector is provided for a connector housing and a flexible lock arm in regard to the lever is formed, comprising:

a lock release spacer which is engaged with a guide rail formed on the connector housing on both sides of the flexible lock arm wherein said lever lock mechanism causes locking condition to release by bending the flexible lock arm by virtue of the lock release spacer;

a guide slope which is formed on a pointed end portion of said flexible lock arm;

an interference portion having a slide contacting slope to said guide slope formed in said lock release spacer; and a contact projection part to said lever formed in said lock release spacer.

2. A lever lock mechanism for a lever fitting type connector according to claim 1, further comprising a flexible working piece which is protrusively formed on a base end of said lock release spacer, and said contact projection part formed on said flexible working piece.

3. A lever lock mechanism for a lever fitting type connector according to any one of claims 1 to 2, further comprising:

a flexible loop piece which is feasible to insert into said guide rail at said lock release spacer;

an engaging projection to said flexible loop piece being formed on the inside of said guide rail; and a stop projection part to said lock release spacer being formed on the inlet side of the guide rail.

4. A lever lock mechanism for a lever fitting type connector in which a lever for fitting of the other connector is provided comprising:

a lock spacer having a flexible arm to said lever which is freely slide engaged with the guide rail formed on said connector housing;

a slide substrate to said guide rail provided on said lock spacer;

a projecting pointed end part extended from said substrate being provided on said flexible lock arm;

a contact projecting part to the claw portion formed on said lever, which is formed on said slide substrate; and a stop projection part to said slide substrate is formed on the inlet side of the guide rail.

* * * * *

UNITED STATES PATENT AND TRADEMARK OFFICE

CERTIFICATE OF CORRECTION

PATENT NO.: 5,630,727
DATED : May 20, 1997
INVENTOR(S): Yazaki Corporation

It is certified that error appears in the above-identified patent and that said Letters Patent is hereby corrected as shown below:

On the title page of the patent item [73], the Assignee, is incorrect in that it is mispelled. Please delete "Yasaki" and add --Yazaki-- therefor.

Signed and Sealed this

Sixth Day of January, 1998

*Attest:*

*Attesting Officer*

BRUCE LEHMAN

*Commissioner of Patents and Trademarks*